US012729598B2

(12) United States Patent
Abdul Rashid

(10) Patent No.: US 12,729,598 B2
(45) Date of Patent: Sep. 8, 2026

(54) ANTI-PRESET MECHANISM FOR PRODUCTION PACKERS

(71) Applicant: Halliburton Energy Services, Inc., Houston, TX (US)

(72) Inventor: Mohammad Abdul Rashid, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/065,114

(22) Filed: Feb. 27, 2025

(65) Prior Publication Data

US 2026/0251033 A1 Aug. 27, 2026

(51) Int. Cl.
*E21B 33/128* (2006.01)
*E21B 33/1295* (2006.01)

(52) U.S. Cl.
CPC ..... *E21B 33/1285* (2013.01); *E21B 33/1295* (2013.01); *E21B 2200/01* (2020.05)

(58) Field of Classification Search
CPC ..... E21B 33/1285; E21B 33/1295
See application file for complete search history.

(56) References Cited

U.S. PATENT DOCUMENTS 4,423,777 A 1/1984 Mullins et al.
4,499,947 A 2/1985 Zsoka et al.
4,624,311 A 11/1986 Goad
5,095,978 A * 3/1992 Akkerman ..... E21B 23/06 166/134
5,501,281 A * 3/1996 White ..... E21B 7/061 166/134
2002/0070034 A1* 6/2002 Whitsitt ..... E21B 33/12 166/134
2015/0198005 A1* 7/2015 Delzell ..... E21B 33/128 166/180
2019/0093449 A1 3/2019 Sanchez
2020/0332622 A1* 10/2020 Fadhil ..... E21B 23/06

OTHER PUBLICATIONS

"PCT Application No. PCT/US2025/019651 International Search Report and Written Opinion", Nov. 13, 2025, 11 pages.

* cited by examiner

*Primary Examiner* — David Carroll
(74) *Attorney, Agent, or Firm* — DeLizio, Peacock, Lewin & Guerra LLP

(57) ABSTRACT

Some implementations include a packer comprising: an upper mandrel; at least one seal coupled with the upper mandrel and configured to radially expand into a casing of a wellbore; a prop configured to axially traverse, in response to hydraulic pressure, along the upper mandrel and cause the seal to radially expand; at least one shear screw configured to hold the prop stationary and in contact with the upper mandrel until sheared; and a snap ring coupled with the prop and configured to prevent axial traversal of the prop along the upper mandrel and radial expansion of the seal.

20 Claims, 7 Drawing Sheets

SECTION K-K

SECTION H-H

ANTI-PRESET MECHANISM FOR PRODUCTION PACKERS

TECHNICAL FIELD

Some implementations relate to packers. More specifically, some implementations relate to production packers configured to resist unintended expansion into casing of a wellbore.

BACKGROUND

A production packer is a device used in wells to establish a seal between the production tubing and the casing, liner, or wellbore wall. This seal may isolate the production zone and prevent migration of fluids between different geological formations. Production packers may be permanent or retrievable, depending on the specific operational requirements. Production packers may protect casing from the pressures and corrosive effects of produced fluids, support the tubing string, and ensure well control by directing the flow through the tubing. In multi-zone wells, production packers may isolate individual reservoir zones, enabling selective production and enhancing overall well efficiency.

BRIEF DESCRIPTION OF THE DRAWINGS

Implementations of the disclosure may be better understood by referencing the accompanying drawings.

FIG. 5 is a schematic diagram of a drilling system.

FIG. 6 is a flow diagram showing operations for utilizing the packer.

DESCRIPTION OF IMPLEMENTATIONS

The description that follows may include example systems, methods, techniques, and program flows that embody implementations of the disclosure. However, this disclosure may be practiced without these specific details. For clarity, some well-known instruction instances, protocols, structures, and techniques may not be shown in detail.

Overview

During operations for hydrocarbon production, an operator may utilize a packer to isolate different sections of a wellbore. The packer may be installed in the tubing string to create a seal between the tubing and casing of the well. This seal may facilitate various production and intervention operations. When installing the packer in the tubing string, an operator may lower the packer into the wellbore to a desired location. At the desired location, the operator may cause the packer to radially expand and interface with the casing (such as by applying hydraulic pressure). Problematically, some traditional packers may malfunction by expanding at undesired locations in the wellbore (sometimes referred to as "pre-set" of the packer). For example, a traditional packer may strike the casing. The casing strike may apply forces that destroy fasteners and other components that cause the packer to pre-set by radially expanding and anchoring to the casing.

Some implementations include a packer configured to withstand forces (such as wellbore strikes) that may otherwise cause traditional packers to radially expand at undesirable wellbore locations. In some implementations, the packer includes a cover sleeve, cover sleeve connector, high-shear screws, and a snap ring all configured to resist forces that may otherwise cause seals and anchors to move into contact with the wellbore. The cover sleeve, cover sleeve connector, high-shear screws, snap ring and other components may be configured to strategically transfer loads (such as from wellbore strikes) to various components to avoid unintended radial expansion into contact with the casing.

Example Implementations

Figure 1A:
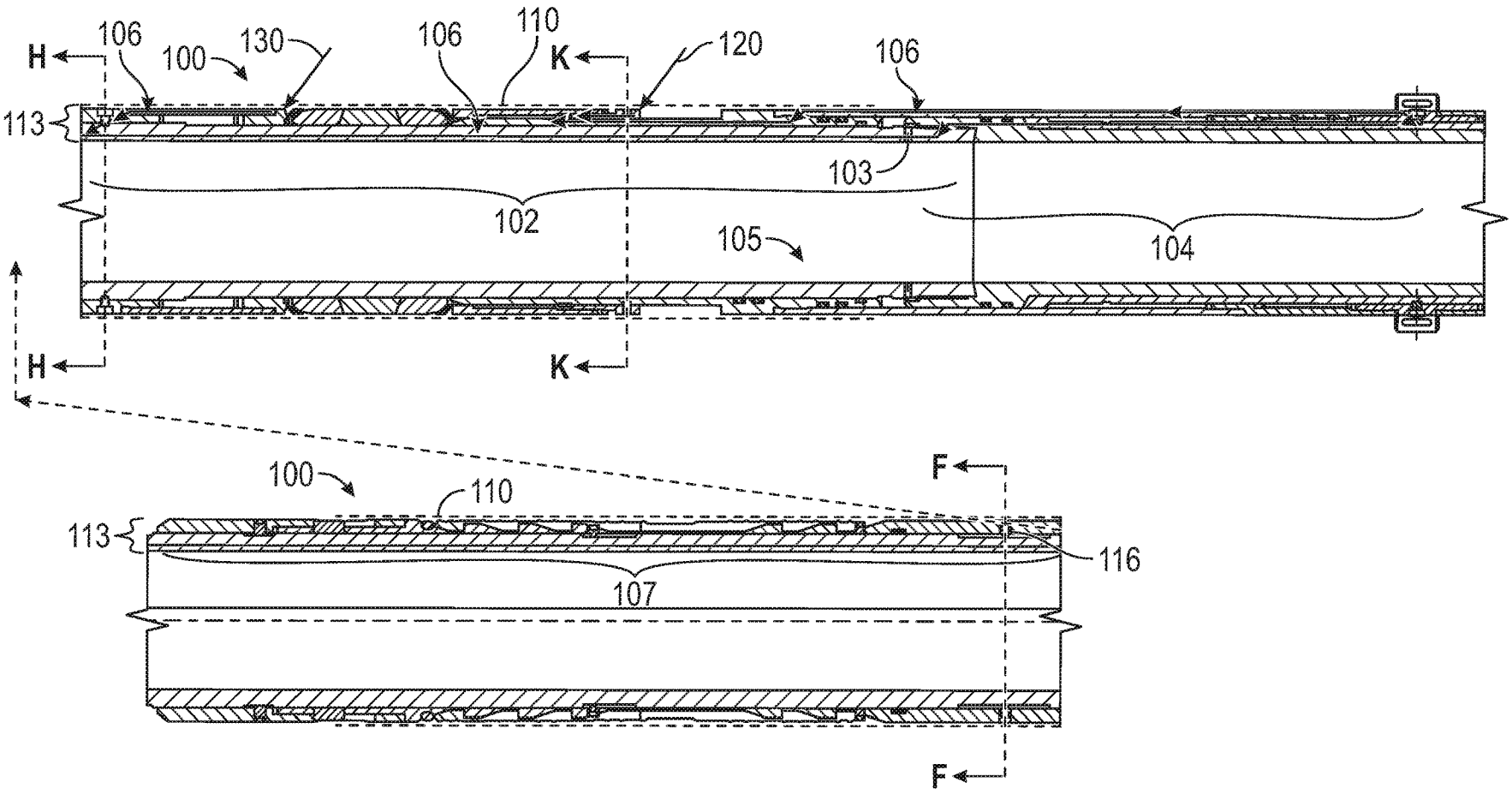
FIGS. 1A-1D are sectional views illustrating components of a packer.

FIGS. 1A-1D are sectional views illustrating components of a packer. FIG. 1A shows portions 102, 104, and 107 of a packer 100. In FIGS. 1A-1D, the packer 100 is in a "run-in-hole" configuration. The portion 107 is shown separately only for spacing and layout of the illustrations. The portion 107 is contiguously joined with the portions 102 and 104 to form a unitary device. The packer 100 may be implemented as a production packer that remains in-use for long durations. The packer 100 may be deployed in a wellbore to seal portions of the casing 110 during subsurface operations for producing hydrocarbons. The casing 110 is not part of the packer 100 but is included for illustrative purposes.

As the packer 100 is lowered into the wellbore, it may strike the casing 110, thereby exerting forces (such as forces 120 and 130) on various components of the packer 100. The packer 100 may avoid damage and unintended radial expansion by distributing these forces to various components of the packer 100. FIG. 1A shows load paths 106 along which forces may be distributed to components of the packer 100. The components and the load paths 106 are described in greater detail with reference to FIGS. 1B-1D.

Figure 1B:
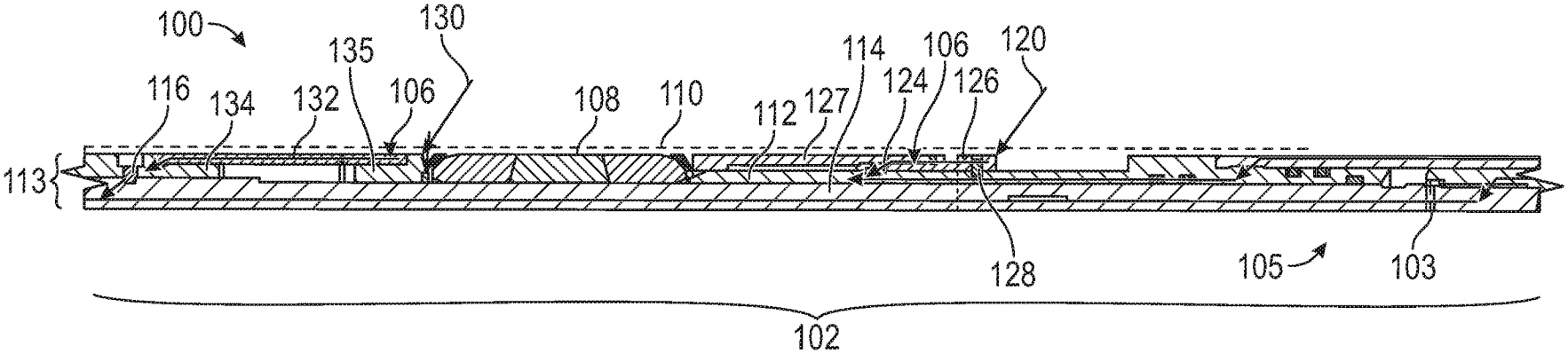

FIG. 1B shows a longitudinal cross-section of the portion 102 of the packer 100. FIG. 1B shows only the top portion 113 of the section view of FIG. 1A.

Operators may pump hydraulic fluid through the tubing 105 into the hydraulic port 103 to exert hydraulic pressure to axially move some components and cause others to radially expand into the casing 110. The hydraulic pressure may drive the lower prop 112 (and other components) along the upper mandrel 114 into the seals 108. In response to force from the lower prop 112, the seals 108 may radially expand into contact with the casing 110. As the seals 108 expand, they may push components residing left of the seals 108 in a leftward direction (as oriented in FIG. 1B). As the components move leftward, they may exert a shearing force large enough to shear off the shear screws 116 and 128 (and other shear screws). The shear screw 116 may hold a lower wedge 134 in place and resist forces that may cause the lower wedge 134 to move. The lower wedge 134 is shown in greater detail with reference to FIG. 1D. In some implementations, the shear screws 116 are made with stronger material to avoid unintended shearing that may result from casing strikes. Additional components (such as the barrel slip 150) (see FIG. 1D) may radially expand into contact with the casing 110 to anchor the packer 100 in a fixed position inside the casing 110. The packer 100 may be configured to remain anchored to the casing 110 after the hydraulic pressure ceases.

The snap ring 124 may be coupled with the lower prop 112 to hold the lower prop 112 in a fixed position. The snap ring 124 may be a c-style snap ring that spans around a portion of the circumference of the upper mandrel 114 (and possibly other components of the packer 100). The snap ring 124 may be recessed inside the cover sleeve connector 126 for protection from casing strikes. A casing strike may apply a force 120 to the cover sleeve connector 126. The force 120 may be distributed through the shear screw 128, cover sleeve 127, cover sleeve connector 126, snap ring 124, and lower prop 112 (see load paths 106 in FIG. 1B). The cover sleeve 127 may have a threaded interface with the cover sleeve connector 126. In some implementations, the snap ring 124 will hold the lower prop 112 and other components in place even if the force 120 shears one or more of the shear screws. By distributing the force, the packer 100 may avoid an unintended radial expansion into the casing 110.

The retainer element 135 may be exposed to a casing strike that exerts a force 130 onto the retainer element 135. The retainer element 135 may distribute the force 130 to the lower wedge extension 132, shear screw 116, and into the upper mandrel 114.

By distributing the forces as described herein, the packer 100 may avoid an unintended radial expansion into the casing 110.

Figure 1C:
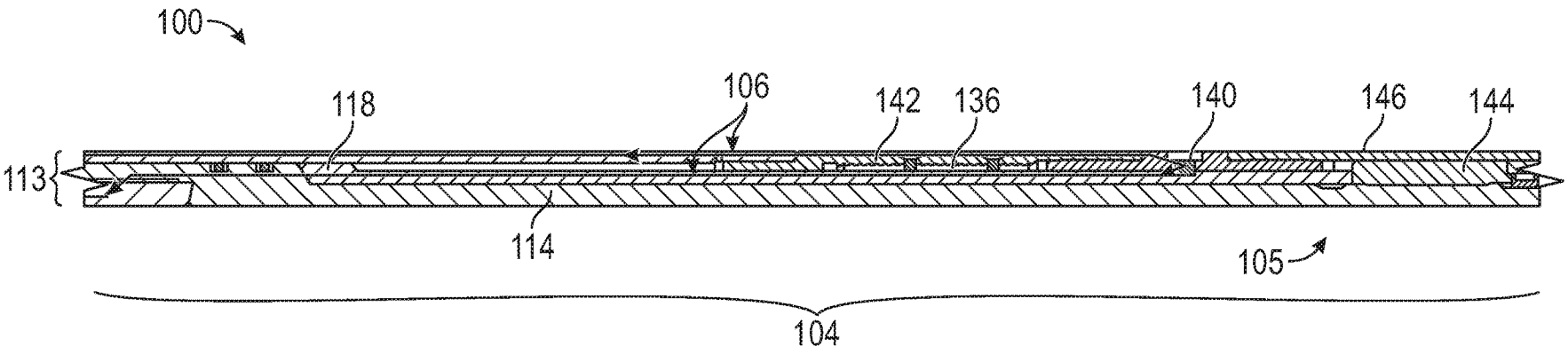
Figure 1D:
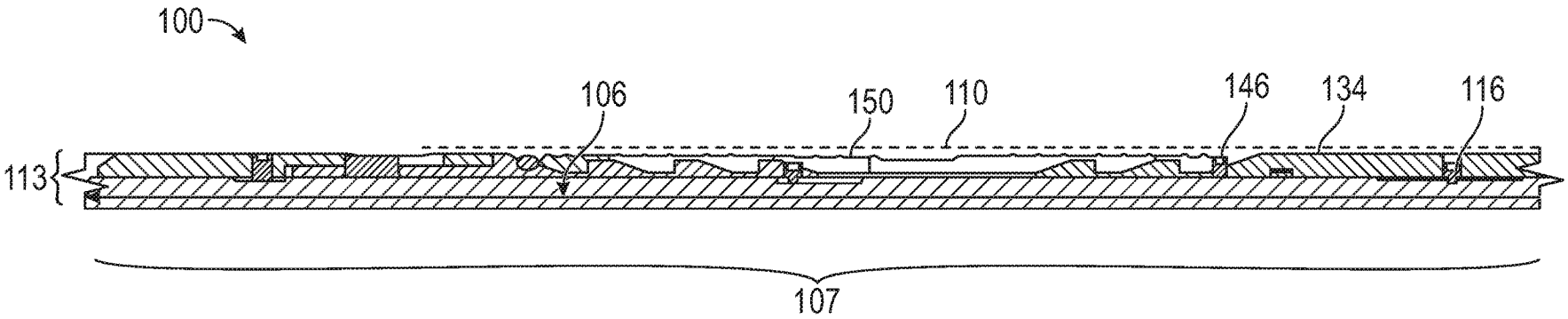

FIG. 1C shows a longitudinal cross-section of the portion 104 of the packer 100. FIG. 1D shows only the top portion 113 (see FIG. 1A). In FIG. 1C, start-to-set screws 140 may hold the piston 118 in a fixed position in contact with the upper mandrel 114. As noted, the hydraulic pressure may axially move components leftward (as oriented in FIGS. 1A-1D), shearing the start-to-set screws 140. In turn, the seals 108 (see FIG. 1B) may move radially outward to mate with the casing 110. The axial movement leftward also may cause the barrel slip 150 (see FIG. 1D) to move radially outward and anchor with the casing 110. After the packer 100 is anchored to the casing 110, a body-lock ring 136 may engage with an internal slip housing 142 and piston 118 to prevent components from moving rightward (back toward their original positions). The body-lock ring 136 may include threads that engage with threads of the internal slip housing 142 and piston 118 to hold these and other components in a fixed position. Also, after the packer 100 is anchored to the casing 110, a lock ring 144 transfers forces in the tubing (such as tension, compression, expansion, contraction, etc.) into the push sleeve 146. The load path 106 shows how loads are distributed through the packer 100 into the piston 118 and through body-lock ring 136 to outer components of packer 100 and finally to casing 110.

Some implementations may include components that utilize well pressure to expand the packer 100. Hence, these implementations may not require operators to pump hydraulic fluid to expand the packer 100.

FIG. 1D a longitudinal cross-section of the portion 107 of the packer 100. FIG. 1D shows only the top portion 113 (see also FIG. 1A). As noted, hydraulic pressure may cause components to move leftward (as oriented in FIGS. 1A-1D)—shearing the shear screws 116 and 128, moving the lower wedge 134 leftward, and moving the barrel slip 150 into contact with the casing. A cross section of the lower wedge 134 and shear screw 116 are described in more detail with reference to FIG. 3. The barrel slip 150 may anchor the packer 100 to the casing 110. The load path 106 shows how loads originating in the portion 104 carry through the portion 107.

Figure 2:
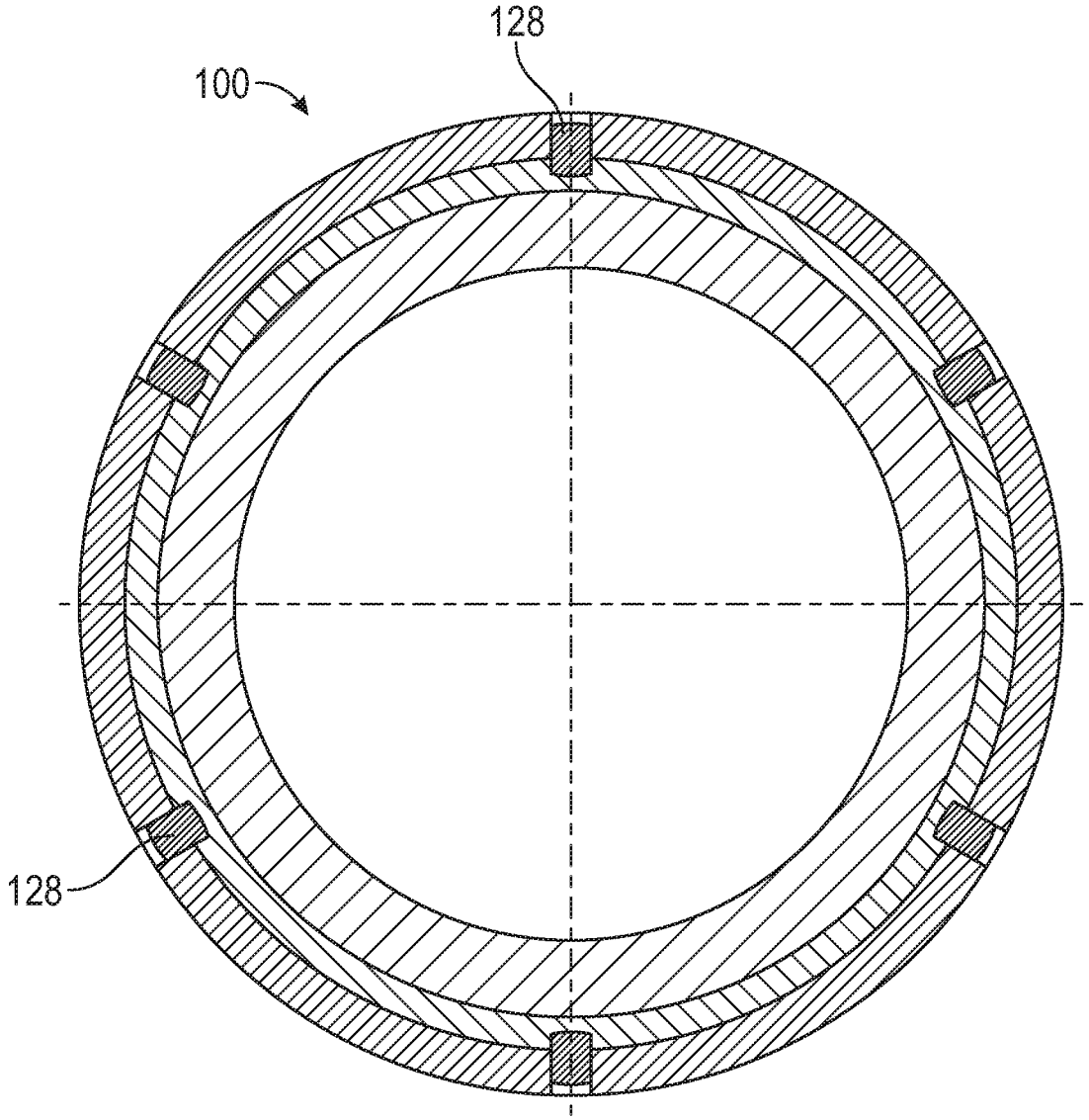
FIG. 2 is a cross-sectional view illustrating the packer.

FIG. 2 is a sectional view illustrating the packer 100. FIG. 2 shows the section K-K (see also FIG. 1A). The packer 100 includes the shear screws 128 . . . . The shear screws 128 may be made from the following materials: B-1112 or C-1213 or C-1018 per ANSI/ASME Standard B 18.8.2. The shear screws 128 may have shear ratings per shear screw ranging from 4470 lbs. to 5470 lbs. For the example shown FIG. 2, six shear screws 128 may have a total shear rating ranging from 26,820 lbs. to 32,820 lbs.

Figure 3:
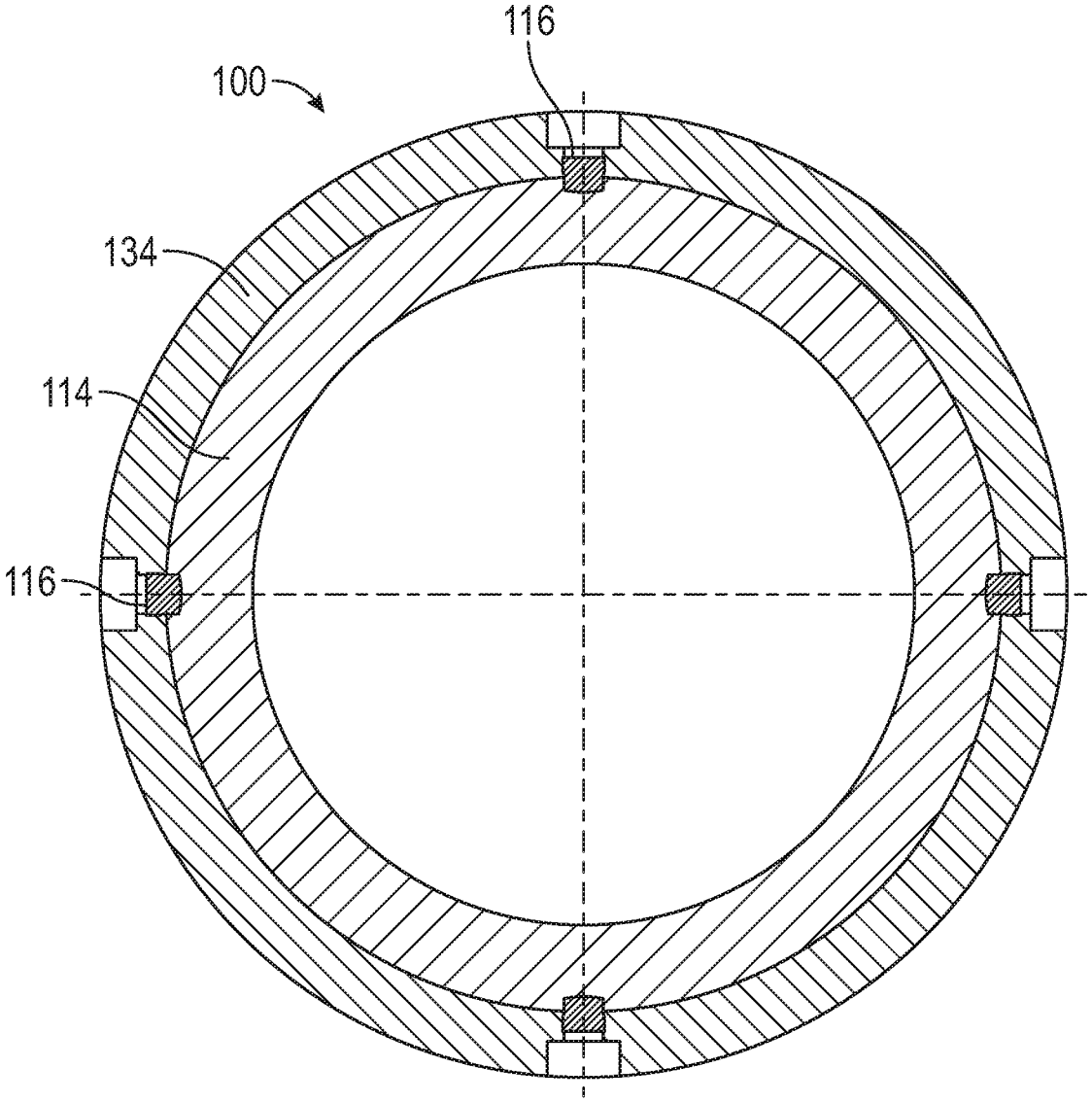
FIG. 3 is a sectional view illustrating a portion of a packer.

FIG. 3 a sectional view illustrating a portion of the packer 100. FIG. 3 shows the section G-G (see also FIG. 1A). The packer 100 includes the shear screws 116. The shear screws described herein may be made from stainless steel. The shear screws 116 may have shear ratings per shear screw ranging from 5400 lbs. to 6600 lbs. For the example in FIG. 3, four shear screws 116 may have a total shear rating ranging from 21,600 lbs. to 26400 lbs.

Figure 4:
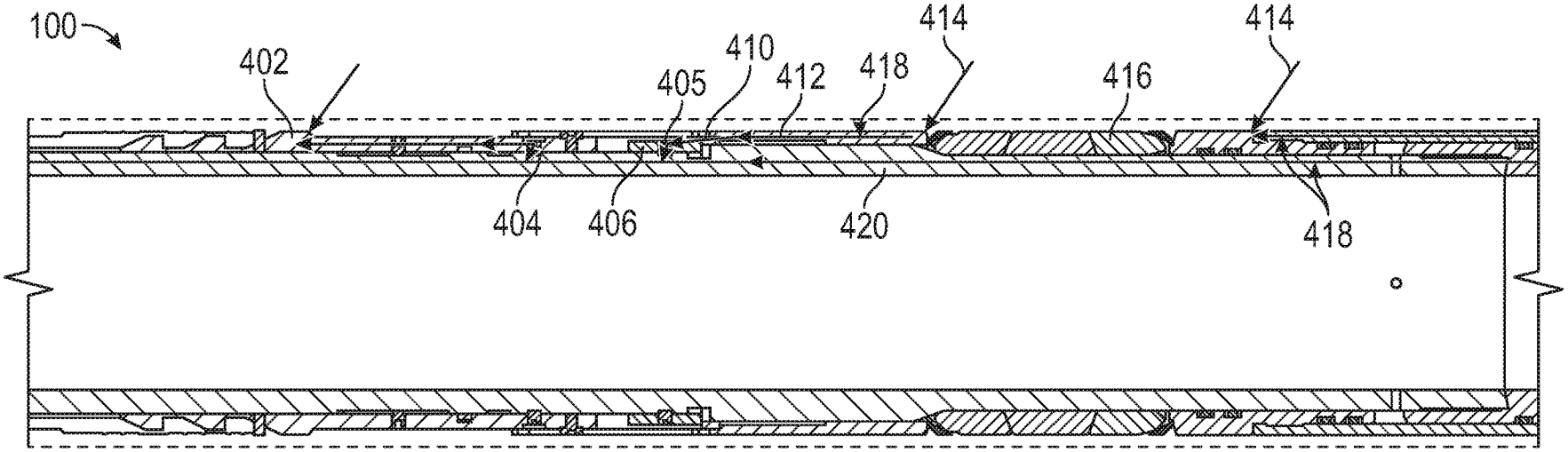
FIG. 4 a sectional view illustrating longitudinal cross-sectional of a packer.

FIG. 4 is a sectional view showing a longitudinal cross-sectional of the packer 100. FIG. 4 shows the packer 100 with an "upper prop" configuration. The packer 100 may include a lower wedge 402, shear screws 404 and 405, support ring 406, c-style snap ring 410, cover sleeve 412, seals 416, and an upper mandrel 420.

As shown, the packer 100 may be configured so the lower wedge 402 is retained in position with shear screws 404 fastened to the upper mandrel 420. The cover sleeve 412 may be retained in position with the c-style snap ring 410. Hence, the packer 100 may withstand impact loads 414 (such as loads arising from the collisions with the casing 110) without causing components to move axially or radially. The packer 100 may distribute the impact loads 414 over the load paths 418.

Example Environment

FIG. 5 is a schematic diagram of a drilling system. For example, in FIG. 5 it can be seen how a drilling system 564 may also form a portion of a drilling rig 502 located at the surface 504 of a well 506. Drilling of oil and gas wells is commonly carried out using a string of drill pipes connected together to form a drilling string 508 that may be lowered through a rotary table 510 into a wellbore or borehole 512. Here a drilling platform 586 may be equipped with a derrick 588 that supports a hoist. A computer system 590 may be used to control one or more operations of the drilling system 564.

The drilling rig 502 may thus provide support for the drill string 508. The drill string 508 may operate to penetrate the rotary table 510 for drilling the borehole 512 through subsurface formations 514. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create a borehole 512 by penetrating the surface 504 and subsurface formations 514. The down hole tool 524 may comprise any of a number of different types of tools including MWD tools, LWD tools, and others.

During drilling operations, the drill string 508 (perhaps including the Kelly 516, the drill pipe 518, and the bottom hole assembly 520) may be rotated by the rotary table 510. In addition to, or alternatively, the bottom hole assembly 520 may also be rotated by a motor (e.g., a mud motor) that may be located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 514.

During drilling operations, a mud pump 532 may pump drilling fluid (sometimes known by those of ordinary skill in the art as "drilling mud") from a mud pit 534 through a hose 536 into the drill pipe 518 and down to the drill bit 526. The drilling fluid may flow out from the drill bit 526 and be returned to the surface 504 through an annular area 540 between the drill pipe 518 and the sides of the borehole 512. The drilling fluid may then be returned to the mud pit 534, where such fluid may be filtered. In some embodiments, the drilling fluid may be used to cool the drill bit 526, as well as to provide lubrication for the drill bit 526 during drilling operations. Additionally, the drilling fluid may be used to remove subsurface formation 514 cuttings created by operating the drill bit 526. It may be the images of these cuttings that many implementations operate to acquire and process.

The drilling system 564 may drill horizontal wellbores for use with hydraulic fracturing and other operations. During such operations, the packer 100 may be installed in the tubing string to create a seal between the tubing and casing of the well. This seal may facilitate various production and intervention operations.

Any of the components described herein and other components may be used in concert with the packer to facilitate operations of the packer (such as to insert, remove, activate, and/or deactivate the packer 100 in the wellbore).

FIG. 6 is a flow diagram showing operations for utilizing the packer. The operations include inserting a packer into the wellbore, wherein the packet includes an upper mandrel; at least one seal coupled with the upper mandrel and configured to radially expand into a casing of a wellbore; a prop configured to axially traverse, in response to hydraulic pressure, along the upper mandrel and cause the seal to radially expand; at least one shear screw configured to hold the prop stationary and in contact with the upper mandrel until sheared; a snap ring coupled with the prop and configured to prevent axial traversal of the prop along the upper mandrel and radial expansion of the seal. The operations also include causing the seal to expand into the wellbore.

FIGS. 1-6 and the operations described herein are examples meant to aid in understanding example implementations and should not be used to limit the potential implementations or limit the scope of the claims. Some implementations may perform additional operations, fewer operations, operations in parallel or in a different order, and some operations differently. Some implementations may perform the operations with different components.

As used herein, a phrase referring to "at least one of" a list of items refers to any combination of those items, including single members. As an example, "at least one of: a, b, or c" is intended to cover: a, b, c, a-b, a-c, b-c, and a-b-c.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

CLAUSES

Some implementations may be characterized by the following clauses.

Clause 1: A packer comprising: an upper mandrel; at least one seal coupled with the upper mandrel and configured to radially expand into a casing of a wellbore; a prop configured to axially traverse, in response to hydraulic pressure, along the upper mandrel and cause the seal to radially expand; at least one shear screw configured to hold the prop stationary and in contact with the upper mandrel until sheared; and a snap ring coupled with the prop and configured to prevent axial traversal of the prop along the upper mandrel and radial expansion of the seal.

Clause 2: The method of clause 1 further comprising: a cover sleeve coupled with the prop and configured to cover the snap ring and a portion of the prop; and a cover sleeve connector coupled with the cover sleeve and the shear screw and configured to protect the shear screw from direct impact with the casing and to transfer an impact force to the snap ring.

Clause 3: The method of any one or more of clauses 1-3, wherein the cover sleeve and cover sleeve connector each include threads configured to threadedly couple the cover sleeve and the cover sleeve connector.

Clause 4: The method of any one or more of clauses 1-3, a lower wedge configured to move axially along the upper mandrel and cause a barrel slip to move radially into contact with the casing of the wellbore.

Clause 5: The method of any one or more of clauses 1-4, a retainer element coupled with the seal, upper mandrel, and a lower wedge extension that is in contact with the lower wedge, the retaining element configured to transfer an exogenous force to the lower wedge extension and on to the lower wedge and upper mandrel.

Clause 6: The method of any one or more of clauses 1-5, wherein the hydraulic pressure originates from a pumping device at surface or from a subsurface formation.

Clause 7: The method of any one or more of clauses 1-6, including a start-to-set screw coupled with a piston and configured to shear from the hydraulic pressure and to hold the piston in contact with a lower mandrel that is coupled with the upper mandrel.

Clause 8: A system comprising: a packer including an upper mandrel; at least one seal coupled with the upper mandrel and configured to radially expand into a casing of a wellbore; a prop configured to axially traverse, in response to hydraulic pressure, along the upper mandrel and cause the seal to radially expand; at least one shear screw configured to hold the prop stationary and in contact with the upper mandrel until sheared; a snap ring coupled with the prop and configured to prevent axial traversal of the prop along the upper mandrel and radial expansion of the seal; and the system also including one or more wellbore components configured to operate the packer in the wellbore.

Clause 9: The system of clause 9, the packer further including: a cover sleeve coupled with the prop and configured to cover the snap ring and a portion of the prop; and a cover sleeve connector coupled with the cover sleeve and the shear screw and configured to protect the shear screw from direct impact with the casing and to transfer an impact force to the snap ring.

Clause 10: The system of any one or more of clauses 9, wherein the cover sleeve and cover sleeve connector each include threads configured to threadedly couple the cover sleeve and the cover sleeve connector.

Clause 11: The system of any one or more of clauses 9-10, the packer further including: a lower wedge configured to move axially along the upper mandrel and cause a barrel slip to move radially into contact with the casing of the wellbore.

Clause 12: The system of any one or more of clauses 9-11, the packer further including: a retainer element coupled with the seal, upper mandrel, and a lower wedge extension that is in contact with the lower wedge, the retaining element configured to transfer an exogenous force to the lower wedge extension and on to the lower wedge and upper mandrel.

Clause 13: The system of any one or more of clauses 9-12, wherein the hydraulic pressure originates from a pumping device at surface or from a subsurface formation.

Clause 14: The system of any one or more of clauses 9-13, the packer further including a start-to-set screw coupled with a piston and configured to shear from the hydraulic pressure and to hold the piston in contact with a lower mandrel that is coupled with the upper. mandrel Clause 15: A method for operating a packer in a wellbore, the method comprising: inserting the packer into the wellbore, wherein the packet includes an upper mandrel; at least one seal coupled with the upper mandrel and configured to radially expand into a casing of a wellbore; a prop configured to axially traverse, in response to hydraulic pressure, along the upper mandrel and cause the seal to radially expand; at least one shear screw configured to hold the prop stationary and in contact with the upper mandrel until sheared; a snap ring coupled with the prop and configured to prevent axial traversal of the prop along the upper mandrel and radial expansion of the seal; and the method further including causing the seal to expand into the wellbore.

Clause 16: The method of clause 15, wherein causing the seal to expand into the wellbore includes applying hydraulic pressure to the packer.

Clause 17: The method of any one or more of clauses 15-16, wherein the hydraulic pressure causes shearing of the shear screw.

Clause 18: The method of any one or more of clauses 15-17, the packer further including: a cover sleeve coupled with the prop and configured to cover the snap ring and a portion of the prop; and a cover sleeve connector coupled with the cover sleeve and the shear screw and configured to protect the shear screw from direct impact with the casing and to transfer an impact force to the snap ring.

Clause 19: The method of any one or more of clauses 15-18, wherein the cover sleeve and cover sleeve connector each include threads configured to threadedly couple the cover sleeve and the cover sleeve connector.

Clause 20: The method of any one or more of clauses 15-19, the packer further including: a lower wedge configured to move axially along the upper mandrel and cause a barrel slip to move radially into contact with the casing of the wellbore.

What is claimed is:

1. A packer comprising:

an upper mandrel;

at least one seal coupled with the upper mandrel and configured to radially expand into a casing of a wellbore;

a prop including a groove and configured to axially traverse, in response to hydraulic pressure, along the upper mandrel and cause the seal to radially expand;

at least one shear screw configured to hold the prop stationary and in contact with the upper mandrel until sheared; and a snap ring disposed in the groove of the prop and configured to prevent axial traversal of the prop along the upper mandrel and radial expansion of the seal.

2. The packer of claim 1 further comprising:

a cover sleeve having a portion in contact with the prop and configured to cover the snap ring and a portion of the prop; and a cover sleeve connector disposed in contact with the snap ring and between a portion of the cover sleeve and a portion of the prop, wherein the cover sleeve connector includes an opening in which the shear screw is disposed, and contact surfaces surrounding the shear screw configured to protect the shear screw from direct impact with the casing and to transfer an impact force to the snap ring.

3. The packer of claim 2, wherein the cover sleeve and cover sleeve connector each include threads configured to threadedly couple the cover sleeve and the cover sleeve connector.

4. The packer of claim 1 further comprising:

a lower wedge configured to move axially along the upper mandrel and cause a barrel slip to move radially into contact with the casing of the wellbore.

5. The packer of claim 1 further comprising:

a retaining element disposed adjacent to the seal, the retaining element including a first contact surface with the upper mandrel, a second contact surface with the lower wedge extension that is in contact with the lower wedge, a shoulder configured to transfer an exogenous force to the lower wedge extension via the second contact surface and upper mandrel via the first contact surface.

6. The packer of claim 1, wherein the hydraulic pressure originates from a pumping device at surface or from a subsurface formation.

7. The packer of claim 1 including a start-to-set screw coupled with a piston and configured to shear from the hydraulic pressure and to hold the piston in contact with a lower mandrel that is coupled with the upper mandrel.

8. A system comprising:

a packer including an upper mandrel;

at least one seal coupled with the upper mandrel and configured to radially expand into a casing of a wellbore;

a prop including a groove and configured to axially traverse, in response to hydraulic pressure, along the upper mandrel and cause the seal to radially expand;

at least one shear screw configured to hold the prop stationary and in contact with the upper mandrel until sheared;

a snap ring disposed in the groove of the prop and configured to prevent axial traversal of the prop along the upper mandrel and radial expansion of the seal; and one or more wellbore components configured to operate the packer in the wellbore.

9. The system of claim 8, the packer further including:

a cover sleeve having a portion in contact with the prop and configured to cover the snap ring and a portion of the prop; and a cover sleeve connector disposed in contact with the snap ring and between a portion of the cover sleeve and a portion of the prop, wherein the cover sleeve connector includes an opening in which the shear screw is disposed, and contact surfaces surrounding the shear screw configured to protect the shear screw from direct impact with the casing and to transfer an impact force to the snap ring.

10. The system of claim 9, wherein the cover sleeve and cover sleeve connector each include threads configured to threadedly couple the cover sleeve and the cover sleeve connector.

11. The system of claim 8, the packer further including:

a lower wedge configured to move axially along the upper mandrel and cause a barrel slip to move radially into contact with the casing of the wellbore.

12. The system of claim 8, the packer further including:

a retaining element disposed adjacent to the seal, the retaining element including a first contact surface in contact with the upper mandrel, a second contact surface in contact with the lower wedge extension that is in contact with the lower wedge, a shoulder configured to transfer an exogenous force to the lower wedge extension via the second contact surface and upper mandrel via the first contact surface.

13. The system of claim 8, wherein the hydraulic pressure originates from a pumping device at surface or from a subsurface formation.

14. The system of claim 8, the packer further including a start-to-set screw coupled with a piston and configured to shear from the hydraulic pressure and to hold the piston in contact with a lower mandrel that is coupled with the upper mandrel.

15. A method for operating a packer in a wellbore, the method comprising:

inserting the packer into the wellbore, wherein the packer includes an upper mandrel;

at least one seal coupled with the upper mandrel and configured to radially expand into a casing of the wellbore;

a prop including a groove and configured to axially traverse, in response to hydraulic pressure, along the upper mandrel and cause the seal to radially expand;

at least one shear screw configured to hold the prop stationary and in contact with the upper mandrel until sheared;

a snap ring disposed in the groove of the prop and configured to prevent axial traversal of the prop along the upper mandrel and radial expansion of the seal; and causing the seal to expand into the wellbore.

16. The method of claim 15, wherein causing the seal to expand into the wellbore includes applying the hydraulic pressure to the packer.

17. The method of claim 15, wherein the hydraulic pressure causes shearing of the shear screw.

18. The method of claim 15, the packer further including:

a cover sleeve having a portion in contact with the prop and configured to cover the snap ring and a portion of the prop; and a cover sleeve connector disposed in contact with the snap ring and between a portion of the cover sleeve and a portion of the prop, wherein the cover sleeve connector includes an opening in which and the shear screw is disposed, and contact surfaces surrounding the shear screw configured to protect the shear screw from direct impact with the casing and to transfer an impact force to the snap ring.

19. The method of claim 18, wherein the cover sleeve and cover sleeve connector each include threads configured to threadedly couple the cover sleeve and the cover sleeve connector.

20. The method of claim 15, the packer further including:

a lower wedge configured to move axially along the upper mandrel and cause a barrel slip to move radially into contact with the casing of the wellbore.

* * * * *